US008545227B2

(12) United States Patent
Downs et al.

(10) Patent No.: US 8,545,227 B2
(45) Date of Patent: Oct. 1, 2013

(54) MATHEMATICS GAME

(76) Inventors: Nelson Patrick Downs, Alexandria, VA (US); Gregory Scott Downs, Alexandria, VA (US)

( * ) Notice: Subject to any disclaimer, the term of this patent is extended or adjusted under 35 U.S.C. 154(b) by 848 days.

(21) Appl. No.: 12/652,191

(22) Filed: Jan. 5, 2010

(65) Prior Publication Data

US 2010/0173270 A1 Jul. 8, 2010

Related U.S. Application Data

(60) Provisional application No. 61/142,448, filed on Jan. 5, 2009.

(51) Int. Cl.
*G09B 23/02* (2006.01)
*G09B 1/00* (2006.01)
*G09B 1/40* (2006.01)

(52) U.S. Cl.
USPC ..... 434/188; 434/191; 434/209; 273/146; 273/236; 273/272

(58) Field of Classification Search
USPC ..... 434/188, 191
See application file for complete search history.

(56) References Cited

U.S. PATENT DOCUMENTS 3,104,106 A * 9/1963 Kenney et al. ..... 273/249
3,314,168 A * 4/1967 Heckman ..... 434/208
3,523,377 A * 8/1970 Gardner ..... 273/299
4,883,277 A * 11/1989 Laisure ..... 273/236
5,083,793 A * 1/1992 Sanford ..... 273/249
5,102,339 A * 4/1992 Parriera ..... 434/191
5,120,226 A * 6/1992 Tsai ..... 434/195
5,176,381 A * 1/1993 Winters ..... 434/209
5,445,390 A * 8/1995 Dutton et al. ..... 273/243
5,478,087 A * 12/1995 Dumisani ..... 273/272
5,529,497 A * 6/1996 Bigold ..... 434/191
5,688,126 A * 11/1997 Merritt ..... 434/128
5,704,790 A * 1/1998 Moses et al. ..... 434/209
5,707,239 A * 1/1998 Butler ..... 434/191
5,782,471 A * 7/1998 Bautista et al. ..... 273/256
5,836,587 A * 11/1998 Druce et al. ..... 273/296
6,056,553 A * 5/2000 Huang ..... 434/188
6,341,779 B1 * 1/2002 Merritt ..... 273/292
6,648,648 B1 * 11/2003 O'Connell ..... 434/188
6,811,402 B1 * 11/2004 Ritchie ..... 434/191
7,520,507 B2 * 4/2009 Gak ..... 273/146
7,614,881 B2 * 11/2009 Bagues ..... 434/188
7,862,337 B2 * 1/2011 Panicali ..... 434/128
7,927,104 B2 * 4/2011 Compton ..... 434/188
2003/0031990 A1 * 2/2003 Venegas, Jr. ..... 434/188
2004/0157197 A1 * 8/2004 Hepner ..... 434/191
2004/0229196 A1 * 11/2004 Ritchie ..... 434/191
2007/0248939 A1 * 10/2007 Miller ..... 434/188
2011/0200975 A1 * 8/2011 AlDeghaishem ..... 434/128
2011/0275038 A1 * 11/2011 Penner ..... 434/188

* cited by examiner

*Primary Examiner* — Nikolai A Gishnock
(74) *Attorney, Agent, or Firm* — Foley & Lardner LLP

(57) ABSTRACT

A mathematics game for playing by a plurality of players using different types of dice, including a first set with predetermined numeric values provided thereon; a second set with "+" or "−" symbols provided thereon (representing positive or negative); and a third set with different mathematical function symbols provided on the respective faces. The game includes a score card provided for each player. The score card includes a region for entering number values corresponding to a throw of the first type of dice; a region for entering "+"/"−" values corresponding to a throw of the second type of dice; a region for entering mathematical functions corresponding to a throw of the third type of dice; a region for entering a mathematical equation based on information in the above regions; and a region for entering a cumulative score of the respective player.

3 Claims, 2 Drawing Sheets

Figure 1

Roll 1

| Numbers | + / - | Functions |
|---|---|---|
| ☐☐ | ☐☐ | ☐ |
| Equation | | |

Cumulative Total _____

Roll 2

| Numbers | + / - | Functions |
|---|---|---|
| ☐☐☐ | ☐☐☐ | ☐☐ |
| Equation | | |

Cumulative Total _____

Roll 3

| Numbers | + / - | Functions |
|---|---|---|
| ☐☐☐☐ | ☐☐☐☐ | ☐☐☐ |
| Equation | | |

Cumulative Total _____

Roll 4

| Numbers | + / - | Functions |
|---|---|---|
| ☐☐☐☐☐ | ☐☐☐☐☐ | ☐☐☐☐ |
| Equation | | |

Cumulative Total _____

Roll 5

| Numbers | + / - | Functions |
|---|---|---|
| ☐☐☐☐☐☐ | ☐☐☐☐☐☐ | ☐☐☐☐☐ |
| Equation | | |

Cumulative Total

MATHEMATICS GAME

CROSS REFERENCE TO RELATED APPLICATIONS

This application is based upon and claims the benefit of priority from prior U.S. Provisional Patent Application 61/142,448, filed Jan. 5, 2009, the entire contents of which are incorporated herein by reference.

FIELD OF THE INVENTION

This invention is related in general to games. This invention relates more particularly to a game that involves learning mathematical equations, to thereby enable a child to learn mathematics in a fun and enjoyable manner.

BACKGROUND OF THE INVENTION

It is well known that children in the U.S. trail other countries when it comes to learning various topics, especially in the field of mathematics. For example, many children cannot fathom mathematical problems that include several functions, such as adding, subtracting, division and multiplication.

There is a desire, as determined by the inventors of this application, to come up with a fun and entertaining way for children to learn about mathematics, by creating a game that utilizes various aspects of mathematics in playing of the game. This game can be used by math teachers as a teaching aid to provide a fun and enjoyable way to teach various mathematical expressions to children.

SUMMARY OF THE INVENTION

The present invention relates to a method and apparatus for a game.

In accordance with one aspect of the invention, there is provided a method of playing a mathematics game by a plurality of players. The method includes:

a) rolling, by each of a plurality of players, n of a first type of dice having a first predetermined number of faces with predetermined number values provided thereon, and entering number values corresponding to a top-face of each of the n of the first type of dice on a score card, n being an integer value greater than or equal to two;

b) rolling, by each of the plurality of players, n of a second type of dice having the first predetermined number of faces with either "+" or "−" symbols provided thereon (representing positive or negative), and entering "+" and/or "−" symbols corresponding to a top-face of each of the n of the second type dice on the score card;

c) rolling, by each of the plurality of players, n−1 of a third type of dice having the first predetermined number of faces with different mathematical function symbols provided thereon, and entering mathematical function symbols corresponding to a top-face of each of the n−1 of the third type dice on the score card;

d) entering an equation created by the respective player on the score card, the equation utilizing information obtained from steps a), b) and c) and correctly solving the equation;

e) entering a cumulative total on the score card from the equation entered in step d) and any previous equations entered for the player on the score card; and f) if n is less than m, incrementing n by one and returning back to step a), wherein m is an integer value greater than or equal to three; and g) if n is equal to m, determining which one of the players has a corresponding cumulative total that is closest to zero, and determining a winner of the game accordingly.

In accordance with another aspect of the invention, there is provided a mathematics game to be played by a plurality of players. The game includes a plurality of different types of dice. One of the different types of dice corresponds to a first set of dice having a first predetermined number of faces with predetermined number values provided thereon. Another of the different types of dice corresponds to a second set of dice having the first predetermined number of faces with either "+" or "−" symbols provided on each of the faces. The "+" represents positive, and the "−" represents negative. The second set of dice are used to modify the value of the numbers of the first set of dice to be either positive numbers or negative numbers. Yet another of the different types of dice corresponds to a third set of dice having the first predetermined number of faces with different mathematical function symbols provided on the respective faces. The game further includes a score card provided for each of the plurality of players, in which the score card includes a first region for entering number values corresponding to a throw of the first type of dice, a second region for entering "+" (positive)/"−" (negative) values corresponding to a throw of the second type of dice, a third region for entering mathematical functions corresponding to a throw of the third type of dice, a fourth region for entering a mathematical equation based on information in the first, second and third regions, and a fifth region for entering a cumulative score of the respective player.

It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of this specification, illustrate several embodiments of the invention and, together with the description, serve to explain the principles of the invention.

FIG. 1 shows a player score card according to a first embodiment of the invention.

DETAILED DESCRIPTION

Figure 2A:
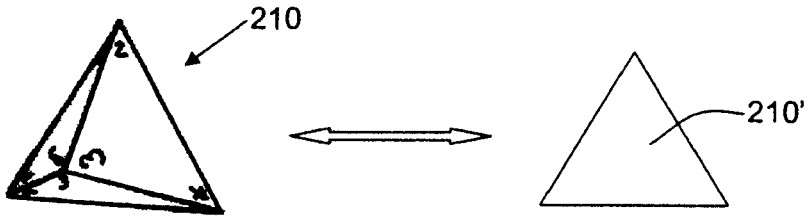
FIGS. 2A-2D show different types of dice that may be utilized in playing a mathematics game according to the first embodiment of the invention.

Reference will now be made in detail to embodiments of the invention, examples of which are illustrated in the accompanying drawings. An effort has been made to use the same reference numbers throughout the drawings to refer to the same or like parts.

Unless explicitly stated otherwise, "and" can mean "or," and "or" can mean "and." For example, if a feature is described as having A, B, or C, the feature can have A, B, and C, or any combination of A, B, and C. Similarly, if a feature is described as having A, B, and C, the feature can have only one or two of A, B, or C.

Unless explicitly stated otherwise, "a" and "an" can mean "one or more than one." For example, if a device is described as having a feature X, the device may have one or more of feature X.

A mathematics learning game called 'Zero Quest' according to an embodiment of the invention is described in detail below. The purpose of the game is to enable people, especially children, to correctly write mathematical equations, and ideally to win the game that is played against at least one other person. The object of the game is to come closest to zero "0" at the end of the game using the numbers and mathematical functions shown on dice that are rolled by each player.

To play the game, each player rolls the number and type of dice shown on a score card. Using the numbers and functions of the rolled dice, each player comes up with an equation, and then the player has to solve the equation. The result of the first equation solved, equation one, is put in a cumulative total line of the score card. When the player's turn to play comes up next, the player rolls the dice, and the result of the second equation solved, equation two, is added to the cumulative total line of the score card and put in its section of the score card. The cumulative total continues until five (5) separate equations (based on five separate turns of a player) have been solved and added together. Each player gets five turns, and the player with the closest cumulative total to zero wins the game.

FIG. 1 is a diagram showing a score card of a player according to an embodiment of the invention. The score card has a first section that includes information from a first roll of dice by the player. As shown in that figure, when it is a player's turn to play the game and make his/her first roll, the player rolls two "numbers" dice, two "+/−" (positive or negative) dice, and a single "functions" dice. For the player's second roll, the player rolls three "numbers" dice, three "+/−" dice, and two "functions" dice. For the player's third roll, the player rolls four "numbers" dice, four "+/−" dice, and three "functions" dice. For the player's fourth roll, the player rolls five "numbers" dice, five "+/−" dice, and four "functions" dice. For the player's fifth and last roll, the player rolls six "numbers" dice, six "+/−" dice, and five "functions" dice. As such, the game includes at least six "numbers" dice, six "+/−" dice, and five "functions" dice.

In one possible implementation of the first embodiment, there are provided nine "numbers" dice, whereby four of the "numbers" dice have the numbers 1, 2, 3, 4, 5 and 6 on the six respective faces of those four dice, whereby two of the "numbers" dice have 2, 4, 6, 8 and 10 on the six respective faces of those two dice, whereby two of the "numbers" dice have 1, 3, 6, 9, 12 and 15 on the six respective faces of those two dice, and whereby the last one of the "numbers" dice has 1, 3, 5, 7, 9 and 11 on the six respective faces of that dice. The player "blindly" picks the "numbers" dice for each turn, such as by reaching into a box that contains the nine "numbers" dice and picking the appropriate number of dice for that turn.

In the example score card shown in FIG. 1, the player rolled "1" and "2" for the pair of numbers dice, "+" and "−" for the pair of "+/−" dice, and "÷" for the single "functions" dice. From those rolls, the following equation was constructed by the player:

$$^{-}1 \div {}^{+}2 = {}^{-}0.5.$$

From this equation, the player enters −0.5 in first roll "Cumulative Total" on the score card for the player.

In the example score card shown in FIG. 1, for the player's second turn, the player rolled "5", "5" and "1" for the "numbers" dice, "−", "−" and "+" for the three "+/−" dice, and "$e^x$" and "÷" for the two "functions" dice. From those rolls, the following equation was constructed by the player:

$$^{-}1^{-5} \div {}^{+}5 = {}^{-1}/_{5} = -0.2$$

From this equation, the player enters −0.7 (e.g., −0.5+−0.2) in second roll "Cumulative Total" on the score card for the player.

In the example score card shown in FIG. 1, for the player's third turn, the player rolled "11", "6", "7", and "1" for the "numbers" dice, "+", "+", "+", and "−" for the "+/−" dice, and "a/x", "−" and "−" for the "functions" dice. From those rolls, the following equation was constructed by the player:

$$^{+7}/_{+11} - {}^{+}6 - {}^{-}1 = {}^{-}4^{4}/_{11} = {}^{-}4.37$$

From this equation, the player enters −5.07 (e.g., −0.5+−0.2+⁻4.37) in the third roll "Cumulative Total" on the score card for the player.

In the example score card shown in FIG. 1, for the player's fourth turn, the player rolled "1", "12", "9", "9" and "5" for the "numbers" dice, "+", "−", "+", "+" and "−" for the "+/−" dice, and "$e^x$", "+", "−" and "×" for the "functions" dice. From those rolls, the following equation was constructed by the player:

$$^{+}12^{-1} \times ({}^{-}9 - {}^{-}9) + {}^{+}5 = {}^{+1}/_{12} \times 0 + {}^{+}5 = {}^{+}5$$

From this equation, the player enters −0.07 (e.g., −0.5+−0.2+⁻4.37+5) in the third roll "Cumulative Total" on the score card for the player.

In the example score card shown in FIG. 1, for the player's fifth (and last) turn, the player rolled "6", "6", "8", "10", "3" and "11" for the "numbers" dice, "+", "−", "+", "+", "+", and "−" for the "+/−" dice, and "÷", "+", "a/x", "÷", and "−" for the "functions dice." From these rolls, the following equation was constructed by the player:

$$({}^{+3}/_{+11} + {}^{-}6 - {}^{-}6) + ({}^{+}10 \div {}^{+}3) = {}^{3}/_{11} \div {}^{10}/_{3} = {}^{3}/_{11} \times {}^{3}/_{10} = {}^{9}/_{110} = 0.08$$

From this equation, the player enters +0.01 (e.g., −0.5+−0.2+⁻4.37+0.08) in the fifth roll "Cumulative Total" on the score card for the player.

At the end of the fifth turn for each player, the player having the closest cumulative total to zero wins. In this example, if the game was played with three total players and if the other two players had cumulative totals after the fifth round of −0.2 and +0.15, respectively, then the player having the cumulative total of +0.01 wins the game. To makes things a bit easier for the players, and to speed up the pace of the game, calculators are allowed, and parentheses can be used in the equations generated after each roll by the players. Also, when entering in the cumulative total for a round, the decimal results are rounded to the nearest $1/100^{th}$. PEMDAS is a mathematical rule that can be used in this game to determine the order of solving equations, whereby PEMDAS stands for Parenthesis, Exponents, Multiplication, Division, Addition, and Subtraction.

According to one possible implementation of the first embodiment, at any turn, if a player incorrectly enters an equation that does not utilize all of various mathematics numbers, +/− and functions information provided by way of a roll of the dice by the player for that particular turn, then the player's score for that particular turn is not counted towards the player's cumulative total score (in effect, the player loses a turn). According to another possible implementation of the first embodiment, the player who incorrectly enters an equation for his/her turn does not lose that turn, but rather is helped by the other players to create a proper equation that does utilize all of the various mathematics numbers, +/− and functions information provided by way of a roll of the dice by the player for that particular turn.

Figure 2B:
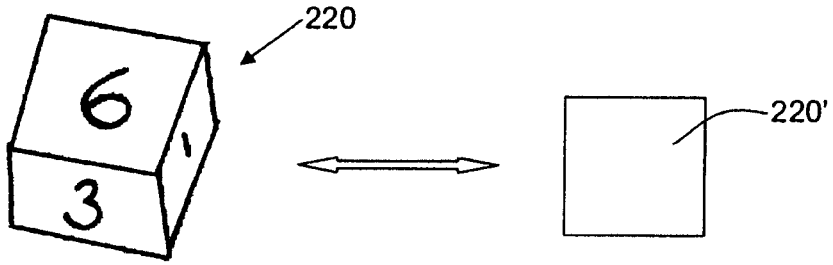
Figure 2C:
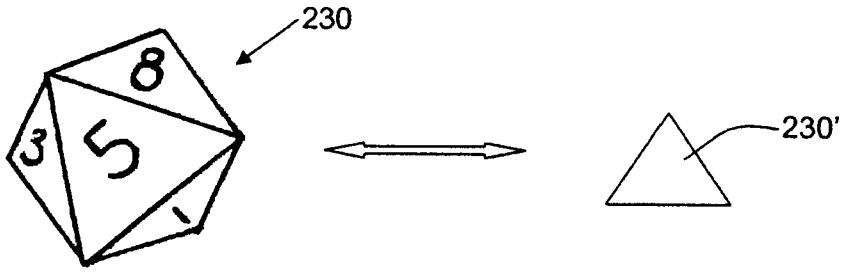
Figure 2D:
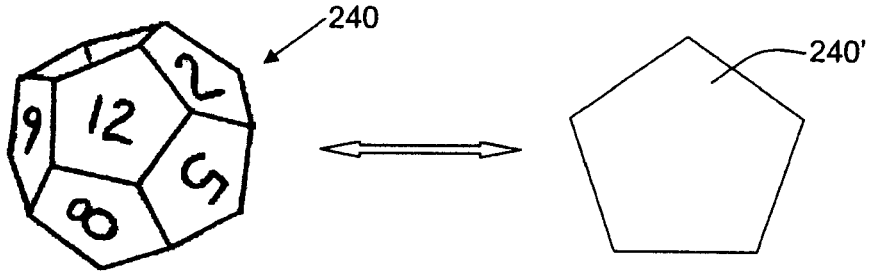

While the first embodiment has been described above with reference to playing with six-sided dice (the standard number of sides of dice), in alternative implementations of the first embodiment, other types of dice having more or less than six sides may be utilized for one or more of the "numbers", the "+/−" dice, and the "functions" dice. For example, FIGS. 2A-2D respectively show a four-sided dice 210 (having triangular faces 210'), a six-sided dice 220 (having square faces 220'), an eight-sided dice 230 (having triangular faces 230'), and a twelve-sided dice 240 (having pentagonal faces 240'). These dice can be utilized for a subset or for all of the "numbers" dice, whereby they may also be utilized for a subset or for all of the "+/−" dice and the "functions" dice (in which case the faces are provided with respective "+/−" symbols or mathematical function symbols).

The embodiments described above have been set forth herein for the purpose of illustration. This description, however, should not be deemed to be a limitation on the scope of the invention. Various modifications, adaptations, and alternatives may occur to one skilled in the art without departing from the claimed inventive concept. For example, the information for each roll of the dice made by each player may be entered on a hand-held computer device having displays that allow such entries, whereby in that implementation a physical (e.g., paper) score card is not utilized, but rather the hand-held computer accumulates the information entered by each player. In this case, the display of the computer device serves the same purpose as the physical score card, whereby each user enters information onto the display of the computer device by way of a user input device. The hand-held device may be programmed by a computer program stored in computer readable media, such as a compact disc, to enable players to play the game using the hand-held device. In a still further implementation, players at different locations can play against each other, by using the Internet and logging into a particular web site that allows such interactive playing by players at different locations. The spirit and scope of the invention are indicated by the following claims.

What is claimed is:

1. A computer-implemented method of playing a mathematics game by a plurality of players, comprising:

a) starting a current round of the game by rolling, by each of a plurality of players, at least two of a first type of dice having a first predetermined number of faces with predetermined number values provided thereon, and entering number values corresponding to a top-face of each of the at least two of the first type of dice on a score card implemented as a computer screen that accepts user input via a user input device;

b) thereafter rolling, by each of the plurality of players, at least two of a second type of dice having the first predetermined number of faces with either "+" or "−" symbols provided thereon (representing positive or negative), and entering "+" and/or "−" symbols corresponding to a top-face of each of the at least two of the second type dice on the score card, the at least two of the second type of dice being equal in number to the at least two of the first type of dice;

c) thereafter rolling, by each of the plurality of players, at least one of a third type of dice having the first predetermined number of faces with different mathematical function symbols provided thereon, wherein mathematical function symbols included on the first predetermined number of faces of the third type of dice comprise:

Addition (+);
Subtraction (−);
Division (÷);
Multiplication (×);
Exponential ($e^x$); and
Ratio (a/x);

and entering mathematical function symbols corresponding to a top-face of each of the at least one of the third type dice on the score card, the at least one of the third type of dice being one less in number to the at least two of the first type of dice;

d) creating, by each of the players, an equation that includes number values obtained from the top-faces of the at least two of the first type of dice, in which the number values are provided with either a positive ("+") value or a negative ("−") value by assigning by the players the corresponding "+" or "−" symbols provided on the respective top-face of the at least two of the second type of dice to the number values provided on the respective top-face of the at least two of the first type of dice, and then including in the equation mathematical functions corresponding to the mathematical function symbols provided on the respective top-face of the at least one of the third type of dice;

e) entering, on the computer screen, the equation created by the respective player in step d) on the score card, the equation utilizing information obtained from steps a), b), and c), and correctly solving the equation;

f) entering, on the computer screen, a cumulative total from the equation entered in step d) and any previous equations entered for the player on the computer screen from any previous rounds of the game that have been completed, thereby completing the current round of the game; and g) if the number of rounds that have been played in the game is less than an agreed upon number of rounds to be played in the game, incrementing the number of each type of dice to be rolled in a round of the game by one and returning back to step b); and h) if the number of rounds that have been played in the game is equal to the agreed upon number of rounds to be played in the game, determining by the computer which one of the players has a corresponding cumulative total that is closest to zero, and thereby determining a winner of the game accordingly.

2. A mathematics game for playing by a plurality of players, comprising:

a plurality of different types of dice, comprising:

a first set of dice having a first predetermined number of faces with predetermined number values provided thereon;

a second set of dice having the first predetermined number of faces with either "+" or "−" symbols provided on each of the faces (representing positive or negative); and a third set of dice having the first predetermined number of faces with different mathematical function symbols provided on the respective faces; wherein mathematical function symbols included on the first predetermined number of faces of the third type of dice comprise:

Addition (+);
Subtraction (−);
Division (÷);
Multiplication (×);
Exponential ($e^x$); and
Ratio (a/x); and a score card provided for each of the plurality of players, the score card implemented as a computer screen that accepts user input by way of a user input device, the score card including user-enterable regions for at least a first roll and a second roll, the score card comprising:

a first region for entering number values corresponding to a throw of the first type of dice;

a second region for entering "+"/"−" values corresponding to a throw of the second type of dice;

a third region for entering mathematical functions corresponding to a throw of the third type of dice;

a fourth region for entering a mathematical equation based on information in the first, second and third regions; and a fifth region for entering a cumulative score of the respective player, wherein the first through third regions each include a plurality of user-enterable sub-regions, with the user-enterable sub-regions for the first roll being one in number less than the user-enterable sub-regions for the second roll for each of the respective first through third regions.

3. The mathematics game according to claim 2, wherein the score card further includes user-enterable regions for a third roll, with the user-enterable sub-regions for the first roll being two in number less than the user-enterable sub-regions for the third roll and with the user-enterable sub-regions for the second roll being one in number less than the user-enterable sub-regions for the third roll for each of the respective first through third regions.

* * * * *